United States Patent [19]

McVeigh et al.

[11] 4,348,681

[45] Sep. 7, 1982

[54] SERIES FED PHASED ARRAY ANTENNA EXHIBITING CONSTANT INPUT IMPEDANCE DURING ELECTRONIC SCANNING

[75] Inventors: Peter J. McVeigh, Hauppauge; Ronald M. Rudish, Commack, both of N.Y.

[73] Assignee: Eaton Corporation, Cleveland, Ohio

[21] Appl. No.: 182,381

[22] Filed: Aug. 29, 1980

[51] Int. Cl.[3] ..... H01Q 3/34

[52] U.S. Cl. ..... 343/854; 343/778

[58] Field of Search ..... 343/854, 776, 777, 778

[56] References Cited

U.S. PATENT DOCUMENTS

| | | | |
|---|---|---|---|
| 3,268,901 | 8/1966 | Reggia et al. | 343/854 |
| 3,328,800 | 6/1967 | Algeo | 343/771 |
| 3,855,597 | 12/1974 | Carlise | 343/768 |

*Primary Examiner*—Eli Lieberman

*Attorney, Agent, or Firm*—Kevin Redmond

[57] ABSTRACT

A distribution system for a phased array antenna comprising a transmission line with couplings positioned to feed the antenna elements in series. Antireciprocal phase shifters are placed in series with the line between couplings to provide previously unavailable features including forced feeding of a scannable array, sweeping the beam of a standing wave system and sweeping the beam of a traveling wave system through boresight.

11 Claims, 4 Drawing Figures

SERIES FED PHASED ARRAY ANTENNA EXHIBITING CONSTANT INPUT IMPEDANCE DURING ELECTRONIC SCANNING

BACKGROUND

1. Field

This invention relates to phased array antennas and, more particularly, to improvement in the distribution systems for such arrays.

2. Prior Art

Phased array antennas generally comprise a plurality of antenna elements in which the phase of the signal supplied to each element is controlled by one or more phase shifters. A series fed array is one in which the radiators are fed via paths which branch off a main transmission line so that this line is effectively in "series" with every path. Succeeding branches coupled to the main line receive a portion of the energy which has not been coupled to the preceeding branches. In a typical application, the main transmission line might be a waveguide and the branch lines might couple from the main guide via holes or slots in the main guide walls.

The series feed is termed traveling-wave type, mixed type, or standing-wave type depending on whether the VSWR in the main waveguide is low, intermediate or high respectively. The traveling wave type achieves the low standing wave ratio by use of a non-reflective termination and by use of branch junctions which introduce little reflection, either because they are lightly coupled to the main line or because the main line is appropriately adjusted to impedance match the junction. The spacing of the branches along the main line of a traveling wave series feed can be almost any value; an exception are values that are near $n\lambda g/2$, where $n=1, 2, 3 \ldots$ etc., and $\lambda g$=guide wavelength, that is, values which are resonant. For these resonant values, the reflections from each of the branch junctions are nearly in phase and add coherently to destroy the pure traveling-wave nature of the feed. Thus, the resonant spacing condition is avoided in a traveling wave type array. For other spacings, reflections from the branch junctions tend to add randomly, so that a nearly pure traveling-wave is maintained along the entire length of the main line.

The standing-wave type achieves the high standing wave ratio by use of a reflective termination and by restricting the coupling between main line and branches so that they only lightly load the main line. The branches are located periodically at voltage minima or maxima, depending on the type of coupling mechanism used; thus the branches are separated by "resonant" intervals of $n\lambda g/2$ in the standing-wave type feed. Although this restriction limits the frequency bandwidth of standing-wave feeds, such feeds are desirable because the use of reflective terminations contributes to high feed efficiency.

Array feeds with resonant spacing between branches are also sometimes chosen because of their ability to "force-feed" radiator elements of appropriate types. A network is said to force feed radiators when the radiation field contribution from each radiator is specified by the network, independent of the way in which the radiators load the network. An important example of the use of force feeding within the prior art is the case where an array of full-wave dipoles is fed to obtain maximum directivity; in this case the optimum feed is by direct shunt along that line. To understand why this is optimum, first consider that the radiation field of a full-wavelength dipole can be shown to be independent of terminal impedance when it is excited by a specified terminal voltage. Thus, to guarantee that an array of such dipoles will produce a far field radiation pattern corresponding to that of a uniformly excited array, which provides maximum directivity, it is only required that the voltages along the transmission line at the branch points be equal.

Next consider how this equality is guaranteed. Campbell's formula in transmission line theory shows that loading a uniform line with pure series or pure shunt elements at multiple half-wavelength intervals produces no change in complex propagation constant. Thus radiating elements placed across the line exactly one guide wavelength apart are excited by voltages of exactly equal magnitude which are exactly in phase regardless of the admittance with which they load the line. This is true even if the loading is unequal because some radiators are near the end and others are near the middle of the array. In effect, for the resonant spacing between branch points, the radiators are simply in parallel with one another. Thus, a uniform excitation is forced and maximum directivity is achieved even though dipole terminal impedances are unequal.

The direction of the beam radiated from the series fed array is dependent on the progressive phase shift $\phi$, between branches along the main feed line as well as any additional progressive phase shift $\psi$ in the branch lines. More specifically, the wavefront radiated by the array is inclined to the plane of the array by the angle $\theta$, where $\sin\theta=(\psi/l)(\theta+\psi)/2$, (the value of $\phi$ being a function of frequency which is given by $\phi=2\pi l/\lambda g-n\pi)\lambda$ is the free space wavelength, l is the interelement spacing and n is restricted to even values, unless adjacent branches alternatively contain 180 degree phase reversals, in which case n is restricted to odd values. Thus, generally the beam peak direction will be frequency dependent, unless this dependence is suppressed by arranging for $\psi$ to compensate for the variation in $\phi$ with frequency. The frequency dependence is sometimes used to scan the direction of the beam by simply varying the frequency of the signal. Alternatively, scanning is achieved by inserting phase shifters in either the branch lines or the main line to vary $\psi$ or $\phi$ respectively while operating at constant frequency. Scanning by varying $\phi$ has an advantage over varying $\psi$ in that all the phase shifters are driven to the same setting, and this setting is a smaller value of phase shift than the average setting of a branch-located phase shifter because the main-line phase shifts are in series and therefore are additive.

In the prior art of standing wave arrays, $\phi$ could not be varied to scan the array since this would violate the resonant spacing condition needed for coupling off the main line at voltage minima or maxima. Thus, the advantages of scanning with $\phi$ have been restricted to cases where traveling wave feeds are used. Even here, usage has been restricted by the need to avoid the resonant spacing with the prior art traveling wave feed, as explained earlier. Resonant spacing corresponds to a broadside scan angle, where $\phi=0$, assuming $\psi=0$, which is the useful case corresponding to identical branch lines. For this reason, traveling wave arrays of the prior art cannot scan close to the broadside direction. Also if it were desired to force feed the prior art array, the need for resonant spacing rules out the possibility of scanning the array by changing $\phi$. Other considerations rule out scanning by changing $\psi$ if force feed is to be maintained.

The description of prior art above has concentrated on traveling-wave and standing wave type examples. Several examples of what has previously been termed a mixed-type feed are also in the prior art. One of particular interest is the case in which the series-feed main-line ends with a nonreflective termination and is constructed with branches at resonant spacings. Such an array could have greater bandwidth that the standing wave type, and yet reap the advantages of force feed. However, its use within the prior art is restricted to cases where the array is not scanned in order to maintain the resonant spacing.

SUMMARY

The present invention overcomes the deficiences in the prior art systems in that it permits beam scanning of standing wave arrays and force-fed arrays by variations of $\phi$. It also permits scanning the traveling wave array through broadside. The invention results in an array whose beam pattern and input impedance are more nearly constant with scan than that for prior art arrays.

The distribution system of the present invention comprises a transmission line with couplings positioned along the line to supply the antenna elements in series. Antireciprocal phase shifters are connected in series with the line between couplings. The sum of the forward and reverse phase shift through an antireciprocal phase shifter is a constant regardless of the value of phase to which the shifter is set. This characteristic causes a traveling wave array to remain as such even when the beam is steered to broadside because the round trip path length from the input port of the distribution system through the transmission line and the phase shifters back to an antenna feed port and back remains constant. Once the couplings for the antenna are positioned to produce a random adding of the reflections at the input port, this condition will remain constant even though the phase through the shifter is changed.

This characteristic of the antireciprocal phase shifter permits a standing wave system to remain as such despite variations in the phase shift through the shifters. These capabilities for traveling wave and standing wave systems are new and useful features not achieved with prior art systems.

DETAILED DESCRIPTION OF THE INVENTION

Figure 1:
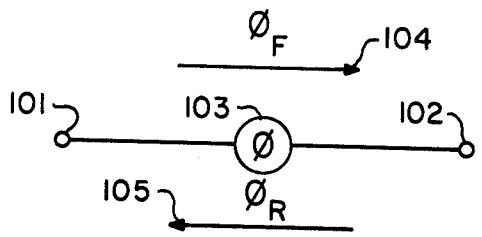
FIG. 1 is a diagram of a phase shifter with an indication of the forward and reverse directions through the shifter and the corresponding phase shift in each direction.

FIG. 1 is a diagram representing a basic phase shifter. In this Figure, the phase shifter is indicated by drawing numeral 103, the input port of the phase shifter by numeral 101 and the output port by numeral 102. The forward direction from the input port to the output port is indicated by arrow 104. The phase shift imparted to a signal passing through the phase shifter in the forward direction is represented by the symbol $\phi_F$, while the reverse direction is indicated by arrow 105 and the phase shift in the reverse direction is represented by the symbol $\phi_R$.

A phase shifter is referred to as "reciprocal" if the forward and reverse phase shifts are equal. It is referred to as "nonreciprocal" if the forward and reverse phase shifts are not equal. It is referred to as "antireciprocal" if the sum of the forward and reverse phase shifts is a constant.

Figure 2:
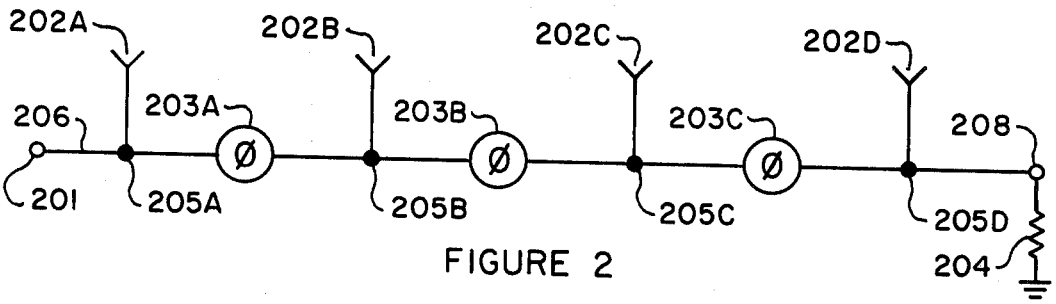
FIG. 2 is a diagram illustrating a phased array antenna and distribution system.

FIG. 2 illustrates a series fed array comprising a distribution system 206 with an input port 201 and an output port 208, couplings 205A through 205D along the distribution system which connect the distribution system to antenna elements 202A through 202D respectively, and termination 204 connected to output port 208. Phase shifters 203A through 203C are placed in series with the distribution system with a phase shifter being located between each pair of adjacent couplings.

The phase shifters may be represented as lengths of transmission line whose phase shift may be chosen to offset the beam pointing direction ($\phi$). By choosing the phase shift imparted by each phase shifter $\phi$ to be equal ($\phi_A=\phi_B=\phi_C$) the beam pointing direction is related to the interelement phase shift ($\phi$) by the following equation:

$$\theta=\sin^{-1}(\lambda_o\phi/2\pi l) \quad (1)$$

where:

$l$=interelement spacing between antenna elements;

$\lambda_o$=free space wavelength; and $\phi$=phase shift between elements

When employing nonreciprocal or antireciprocal phase shifters, the main beam pointing direction is specified by $\phi_F$ in FIG. 1 and Equation (1). The nominal input admittance ($Y_{in}$) of such an array is a function (F) of the individual branch admittances ($Y_i$), the round trip phase shift ($\phi_F+\phi_R$), and the reflection coefficient ($\Gamma_1$) of termination 204.

$$Y_{in}=F(Y_i, \phi_F+\phi_R, \Gamma_1) \quad (2)$$

If the phase shifters are exactly antireciprocal, then ($\phi_F+\phi_R$) is a constant even as $\phi_F$ is changed to steer the beam. Thus, the input admittance will also tend to be constant. Second order changes to $Y_{in}$ may occur due to changes in $Y_i$ induced by mutual coupling as the array is scanned.

For traveling wave arrays using antireciprocal phase shifters, $\Gamma_1$ is zero and the average phase ($\phi_F+\phi_R$) is chosen to be any value in the range which is normally acceptable for the reciprocal interelement phase shift in traveling wave arrays. For example, $(\phi_F+\phi_R)/2$ is chosen to be in the range such that the resulting beam pointing direction $\phi_A$ in a conventional array with this value of interelement phase shift, is a minimum of one beamwidth from the broadside ($\theta=0$) beam position. This ensures that the reflections from each of the branch junctions would tend to add randomly and thus prevent a standing wave from building up along the array. Because the value of ($\phi_F+\phi_R$) is a constant as $\phi_F$ is changed to scan the array, this condition in which standing wave growth is inhibited is maintained as the array is scanned, even if it is scanned through broadside.

For standing wave arrays, $\Gamma_1$ is chosen to be unity and the sum of $\phi_F$ and $\phi_R$ must be multiples of 360 degrees if the branch points are to be located at voltage minima or maxima. If perfectly antireciprocal phase shifters are used, this sum may be set at 360 degrees, or a multiple of 360, by design and it will remain at this value as $\phi_F$ is changed electronically to steer the beam. Thus, steering a standing-wave array is possible if antireciprocal phase shifters are utilized.

Figure 3:
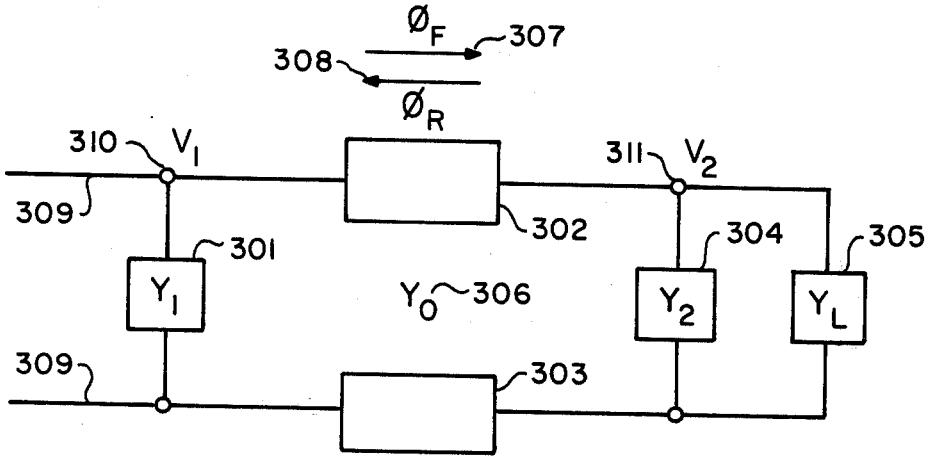
FIG. 3 is a diagram of a segment of the main line of a phase array distribution system illustrating the admittances appearing at two branches along the line.

FIG. 3 represents a segment of the main line 309 of the distribution system comprising a first branch 310, a second branch 311, a first branch admittance $Y_1$, a second branch admittance $Y_2$, a load admittance $Y_L$ which includes the succeeding branch admittances as transformed by succeeding line sections as well as the line termination appropriately transformed, a series phase shifter (and interconnecting transmission lines of the same characteristic admittance) represented by blocks 302 and 303 which exhibit a forward phase $\phi_F$ 307 and a reverse phase $\phi_R$ 308 and a characteristic admittance $Y_o$ 306. The sum of the second branch admittance and the load admittance (normalized to the characteristic admittance of the phase shifter) is represented by the admittance Y'.

The ratio of the voltages at two successive branch points along the line (FIG. 3) can be shown to be equal to the function:

$$V_1/V_2 = e^{-j(\phi_R-\phi_F)/2}[\cos(\phi_F+\phi_R)/2 + jY' \sin(\phi_F+\phi_R)/2] \quad (3)$$

If the sum of $\phi_F$ and $\phi_R$ is a multiple of 360 degrees, the term in Equation (3) which contains Y' drops out of the equation and the voltage ratio becomes independent of branch admittances. This is force feed. In a series-fed array using perfectly antireciprocal phase shifters the value of $(\phi_F+\phi_R)/2$ can be set to a multiple of 180 degrees by design and will remain there as $(\phi_R-\phi_F)$ is varied electronically to steer the beam. Thus, force-feed can be maintained in a steered series-fed array using antireciprocal phase shifters.

Important elements of this invention are the use of antireciprocal phase shifters in the main line or distribution system of a series of feed and the recognition that:

1. The input impedance of a series-fed array is a function of the round trip or average of forward and reverse phase shift between elements.

2. The beam pointing direction is a function of the phase shift in one direction only ($\phi_F$).

3. Toroidal nonreciprocal phase shifters can be designed so as to provide the antireciprocal properties necessary for the invention.

Figure 4:
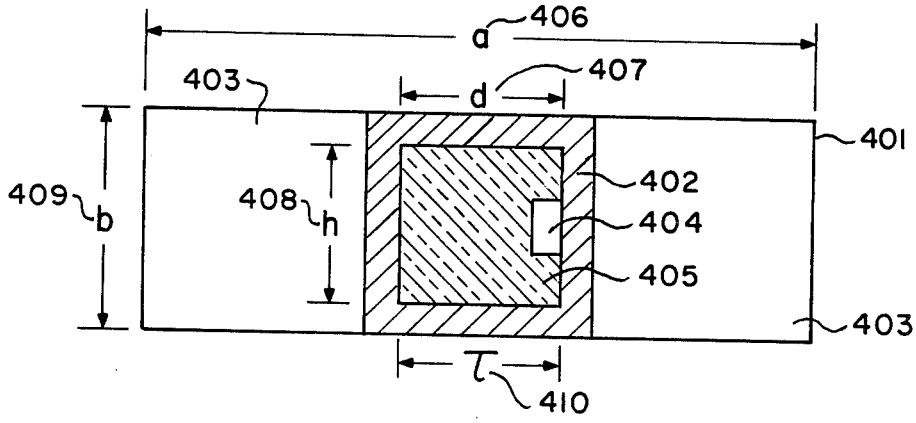
FIG. 4 is a cross sectional diagram of a waveguide phase shifter suitable for providing antireciprocal characteristics.

A key element in the invention is the antireciprocal phase shifter. By design analysis construction and measurement we have shown that it is possible to obtain antireciprocal properties with a properly designed toroidal waveguide phase shifter. FIG. 4 shows a typical cross section of a toroidal waveguide ferrite phase shifter. In this Figure, the waveguide cross section comprises a waveguide 401, a ferrite toroid 402, air space between the toroid and the waveguide wall 403, a high dielectric constant insert 405 filling the center of the toroid, and a hole 404 in the high dielectric constant insert adjacent the toroid to permit the passage of the control loop for the toroid. Dimensions of the cross section include the guide width a 406, the guide height b 409, and toroid width T 410, the high dielectric constant insert width d 407, and the insert height h 408.

It is possible to analyze the propagation constant for the structure shown in FIG. 4. Such analysis is usually made to optimize parameters such as low insertion loss, maximum phase shift per unit length, or flatness of the differential phase shift as a function of frequency.

However, we have determined that this structure also may be optimized for nearly constant round trip phase shift. This "antireciprocal" feature of the phase shifter can be optimized empirically by reiteratively measuring the propagation constants of a physical structure each time one of the dimensions is changed, or by the computer analysis.

A computer analysis for this purpose was carried out. To confirm the validity of the computer analysis, an experiment was undertaken. In this experiment the dimensions of an existing toroid were inputted and fixed in the computer analysis and the waveguide width and frequency of operation were varied. A waveguide width was found in which the phase shifter exhibited nearly antireciprocal properties over a range of frequencies. The toroid was then installed in the designed waveguide and tested over a broad frequency range. In the band of frequencies predicted by the theoretical analysis it exhibited very nearly perfect antireciprocal behavior, thus confirming the validity of that analysis and more importantly demonstrating that toroidal nonreciprocal phase shifters may be especially designed to provide the required antireciprocal property required for the present invention.

Specifically, a WR 137 waveguide was used with a toroid having the $\tau$ dimension (410) equal to 0.290 inch. The high dielectric constant insert has a relative dielectric constant of 37, an h dimension 408 of 0.406 inch, and a d dimension 407 of 0.074 inch. The slot 404 for the control loop was 0.020 inch square.

A three inch long toroid of the above cross sectional dimensions was mounted into a WR 137 waveguide. Appropriate matching of each end of the toroid to the empty waveguide was installed. A variation of ±2 percent in the round trip phase was measured at a frequency of 5.83 GHz. The one way phase was varied from 0 to 360 degrees.

Alternate equivalent structures are considered within the scope of the invention. For example, the described implementation of the invention for the standing wave case utilizes main line sections of transmission line of constant characteristic impedance. Other forms of the invention utilize line sections which are made of two or more lines of different characteristic impedances. This latter approach offers the opportunity to transform voltages in a force-feed array so that a prescribed set of unequal voltages can be impressed at the branch points, and maintained with scan, independent of branch impedance variations.

We claim:

1. A traveling wave distribution system for a phased array antenna, comprising:

(a) means for propagating an electromagnetic signal, said means having an input port and an output port, (b) a plurality of means for coupling from the means for propagating to the antenna elements in the phased array, said means for coupling supplying the antenna elements in series and said means for coupling being positioned along the means for propagating at nonresonant points, (c) a plurality of antireciprocal means for shifting the phase of the electromagnetic signal, each of the means for shifting the phase remaining substantially antireciprocal over the useful scanning range of the array and being connected in series with the means for propagating between the means for coupling, (d) a resistive termination connected to the output port of the means for propagating, and (e) means for controlling the phase shift of the plurality of antireciprocal means for shifting the phase to produce an equal phase shift through each of such elements.

2. A standing wave distribution system for a phased array antenna, comprising:

(a) means for propagating an electromagnetic signal, said means having an input port and an output port, (b) a plurality of means for coupling from the means for propagating to the antenna elements in the phased array, said means for coupling supplying the antenna elements in series and said means for coupling being positioned along the means for propagating at resonant points, (c) a plurality of antireciprocal means for shifting the phase of the electromagnetic signal, each of the means for shifting the phase remaining substantially antireciprocal over the useful range of the array and being connected in series with the means for propagating between the means for coupling, (d) a reflective termination being connected to the output port of the means for propagating, and (e) means for controlling the phase shift of the plurality of antireciprocal means for shifting the phase to produce an equal phase shift through each of such elements.

3. A distribution system as claimed in claim 2, further comprising fixed means for matching the input impedance of the means for propagating, the input impedance remaining essentially invarient with the variation of the forward path length through the means for shifting the phase, where the effect on the input impedance due to mutual coupling between antenna elements is negligible.

4. A forced fed uniformly excited standing-wave phased array antenna, comprising:

(a) means for propagating an electromagnetic signal, said means having an input port and an output port, (b) a plurality of antenna elements whose radiation characteristics are determined by the voltage supplied to the elements by their shunt connections to said means for propagating, (c) a plurality of means for shunt coupling from the means for propagating to the antenna elements, (d) a plurality of antireciprocal means for shifting the phase of the electromagnetic signal, each of the means for shifting the phase remaining substantially antireciprocal over the useful scanning range of the array and having the same characteristic impedance as the means for propagating, each of the means for shifting the phase being positioned in series with the means for propagating between the means for coupling, the sum of forward and reverse propagation path lengths between each means for coupling including the path lengths through the means for shifting being an integral number of wavelengths of the electromagnetic signal to force the voltages at the shunt means for coupling to be identical to each other, (e) a reflective termination connected to the output port of the means for propagating, (f) means for matching the input impedance of the means for propagation the signal, said input impedance being equal to the reciprocal of the sum of the admittances which the antenna elements place in shunt with the means for propagating, the input impedance remaining essentially invariant with variation of the forward path length through the means for shifting phase, where the effects of inter-antenna-element mutual coupling are neglible, and (g) means for controlling the phase shift of the plurality of antireciprocal means for shifting the phase.

5. A forced fed uniformly excited standing-wave phased array antenna, comprising:

(a) means for propagating an electromagnetic signal, said means having an input port and an output port, (b) a plurality of antenna elements whose radiation characteristics are determined by the voltage supplied to the elements by their shunt connections to said means for propagating, (c) a plurality of means for shunt coupling from the means for propagating to the antenna elements, (d) a plurality of antireciprocal means for shifting the phase of the electromagnetic signal, each of the means for shifting the phase remaining substantially antireciprocal over the useful scanning range of the array and having the sum of its forward and reverse path lengths being equal to an integral number of wavelengths of the propagating signal, each of the means for shifting the phase being positioned in series with the means for propagating between the means for coupling, the sum of forward and reverse propagation path lengths between each means for coupling including the path lengths through the means for shifting being an integral number of wavelengths of the electromagnetic signal to force the voltages at shunt means for coupling to be identical to each other, (e) a reflective termination connected to the output port of the means for propagating, (f) means for matching the input impedance of the means for propagating the signal, said input impedance being equal to the reciprocal of the sum of the admittances which the antenna elements place in shunt with the means for propagating, the input impedance remaining essentially invariant with variation of the forward path length through the means for shifting phase, except for the effects of inter-antenna-element mutual coupling, and (g) means for controlling the phase shift of the plurality of antireciprocal means for shifting the phase.

6. A forced fed uniformly excited standing-wave phased array antenna, comprising:

(a) means for propagating an electromagnetic signal, said means having an input port and an output port, (b) a plurality of antenna elements whose radiation characteristics are determined by the current supplied to the elements by their series connections to said means for propagating, (c) a plurality of means for series coupling from the means for propagating to the antenna elements, (d) a plurality of antireciprocal means for shifting the phase of the electromagnetic signal, each of the means for shifting the phase remaining substantially antireciprocal over the useful scanning range of the array and having the sum of its forward and reverse path lengths being equal to an integral number of wavelengths of the propagating signal, each of the means for shifting the phase being positioned in series with the means for propagating between the means for coupling, the sum of forward and reverse propagation path lengths between each means for coupling including the path lengths through the means for shifting being an integral number of wavelengths of the electromagnetic signal to force the currents at series means for coupling to be identical to each other, (e) a reflective termination connected to the output port of the means for propagating, (f) means for matching the input impedance of the means for propagating the signal, said input impedance being equal to the sum of the impedances which the antenna elements place in series with the means for propagating, the input impedance remaining essentially invariant with variation of the forward path length through the means for shifting phase, except for the effect of inter-antenna-element coupling, and (g) means for controlling the phase shift of the plurality of antireciprocal means for shifting the phase.

7. A forced fed uniformly excited standing-wave phased array antenna, comprising:

(a) means for propagating an electromagnetic signal, said means having an input port and an output port, (b) a plurality of antenna elements whose radiation characteristic are determined by the current supplied to the elements by their series connections to said means for propagating, (c) a plurality of means for series coupling from the means for propagating the antenna elements, (d) a plurality of antireciprocal means for shifting the phase of the electromagnetic signal, each of the means for shifting the phase remaining substantially antireciprocal over the useful scanning range of the array and having the same characteristic impedance as the means for propagating, each of the means for shifting the phase being positioned in series with the means for propagating between the means for coupling, the sum of forward and reverse propagation path lengths between each means for coupling including the path lengths through the means for shifting being an integral number of wavelengths of the electromagnetic signal to force the currents at series means for coupling to be identical to each other, (e) a reflective termination connected to the output port of the means for propagating, (f) means for matching the input impedance of the means for propagating the signal, said input impedance being equal to the sum of the impedance which the antenna elements place in series with the means for propagating, the input impedance remaining essentially invariant with variation of the forward path length through the means for shifting phase, except for the effects of inter-antenna-element mutual coupling, and (g) means for controlling the phase shift of the plurality of antireciprocal means for shifting the phase.

8. A forced-fed arbitrarily-excited standing wave phased array antenna, comprising:

(a) means for propagating an electromagnetic signal, said means having an input port and an output port, (b) a plurality of antenna elements whose radiation characteristic are determined by the voltage supplied to the elements by their shunt connections to said means for propagating, (c) a plurality of means for shunt coupling from the means for propagating to the antenna elements, (c) a plurality of antireciprocal means for shifting the phase of the electromagnetic signal, each of the means for shifting the phase remaining substantially antireciprocal over the useful scanning range of the array and having the sum of its forward and reverse path lengths being equal to an odd integral number of half wavelengths of the propagating signal, each of the means for shifting the phase being positioned in series with the means for propagating between the means for coupling, the sum of forward and reverse propagation path lengths between each means for coupling including the path lengths through the means for shifting being an integral number of wavelengths of the electromagnetic signal to force the voltages at successive shunt means for coupling to be in the ratio of the characteristic impedances of the intervening section of means for propagating and of the means for shifting phase, (e) a reflective termination connected to the output port of the means for propagating, (f) means for matching the input impedance of the means for propagating the signal, said input impedance being equal to the reciprocal of the sum of the admittance, which the antenna elements place in shunt with the means for propagating, the input impedance remaining essentially invariant with variation of the forward path length through the means for shifting phase, except for the effects of inter-antenna-element coupling, and (g) means for controlling the phase shift of the plurality of antireciprocal means for shifting the phase.

9. A forced fed arbitrarily-excited standing wave phased array antenna, comprising:

(a) means for propagating an electromagnetic signal, said means having an input port and an output port, (b) a plurality of antenna elements whose radiation characteristic are determined by the current supplied to the elements by their series connections to said means for propagating, (c) a plurality of means for series coupling from the means for propagating to the antenna elements, (d) a plurality of antireciprocal means for shifting the phase of the electromagnetic signal, each of the means for shifting the phase remaining substantially antireciprocal over the useful scanning range of the array and having the sum of its forward and reverse path lengths being equal to an odd integral number of half-wavelengths of the propagating signal, each of the means for shifting the phase being positioned in series with the means for propagating between the means for coupling, the sum of forward and reverse propagation path lengths between each means for coupling including the path lengths through the means for shifting being an integral number of wavelengths of the electromagnetic signal to force the currents at successive series means for coupling to be in the ratio of the characteristic impedances of the intervening section of means for propagating and of the means for shifting phase, (e) a reflective termination connected to the output port of the means for propagating, (f) means for matching the input impedance of the means for propagating the signal, said input impedance being equal to the sum of the impedances which the antenna elements place in series with means for propagating, the input impedance remaining essentially invariant with variation of the forward path length through the means for shifting phase, except for the effects of inter-antenna-element coupling, and (g) means for controlling the phase shift of the plurality of antireciprocal means for shifting the phase.

10. A method for providing a traveling wave distribution system for a phased array antenna, comprising the steps of:

(a) providing means for propagating an electromagnetic signal, said means having an input port and an output port, (b) providing a plurality of means for coupling from the means for propagating to the antenna elements in the phased array, said means for coupling supplying the antenna elements in series and said means for coupling being positioned along the means for propagating at nonresonant points, (c) providing a plurality of antireciprocal means for shifting the phase of the electromagnetic signal, each of the means for shifting the phase remaining substantially reciprocal over the useful scanning range of the array and being connected in series with the means for propagating between the means for coupling, (d) providing a resistive termination connected to the output port of the means for propagating, and (e) controlling the phase shift of the plurality of antireciprocal means for shifting the phase to produce an equal phase shift through each of such elements.

11. A method for providing a standing wave distribution system for a phased array antenna, comprising:

(a) providing means for propagating an electromagnetic signal, said means having an input port and an output port, (b) providing a plurality of means for coupling from the means for propagating to the antenna elements in the phased array, said means for coupling supplying the antenna elements in series and said means for coupling being positioned along the means for propagating at resonant points, (c) providing a plurality of antireciprocal means for shifing the phase of the electromagnetic signal, each of the means for shifting the phase remaining substantially antireciprocal over the useful scanning range of the array and being connected in series with the means for propagating between the means for coupling, (d) providing a reflective termination connected to the output port of the means for propagating, and (e) controlling the phase shift of the plurality of antireciprocal means for shifting the phase to produce an equal phase shift through each of such elements.

* * * * *